US005538071A

United States Patent [19]

Johansson et al.

[11] Patent Number: 5,538,071

[45] Date of Patent: Jul. 23, 1996

[54] MACHINE AND METHOD OF CONTINUOUSLY CASTING A METAL STRIP

[75] Inventors: Lars G. Johansson, Luleå ; Ralph Nyström, Sunderbyn, both of Sweden

[73] Assignee: Mannesmann Aktiengesellschaft, Düsseldorf, Germany

[21] Appl. No.: 177,626

[22] Filed: Dec. 30, 1993

U.S. Patent Application Data

[63] Continuation-in-part of PCT/SE92/00496, Jul. 1, 1991.

[30] Foreign Application Priority Data

Jul. 1, 1991 [SE] Sweden ..... 9102022

[51] Int. Cl.[6] ..... B22D 11/06; B22D 11/10; B22D 11/18

[52] U.S. Cl. ..... 164/479; 164/155.4; 164/429; 164/438; 164/453; 164/489

[58] Field of Search ..... 164/479, 489, 164/429, 438, 453, 155.4

[56] References Cited

U.S. PATENT DOCUMENTS

| | | | |
|---|---|---|---|
| 1,180,728 | 4/1916 | Klocke | 164/479 X |
| 1,612,737 | 12/1926 | Lane . | |
| 2,348,178 | 5/1944 | Merle | 164/429 X |
| 3,743,138 | 7/1973 | Lyman | 164/438 X |
| 3,765,572 | 10/1973 | Neumann et al. | 164/438 X |
| 3,895,673 | 7/1975 | Gerding et al. | 164/429 X |
| 3,907,022 | 9/1975 | Simons et al. | 164/489 |

FOREIGN PATENT DOCUMENTS

| | | | |
|---|---|---|---|
| 0334802 | 9/1989 | European Pat. Off. | 164/429 |
| 2058618 | 6/1971 | Germany . | |
| 2213111 | 11/1972 | Germany . | |
| 55-33858 | 3/1980 | Japan | 164/438 |
| 59-159250 | 9/1984 | Japan | 164/479 |
| 1614893 | 12/1990 | U.S.S.R. | 164/429 |
| WO88/02288 | 4/1988 | WIPO . | |

*Primary Examiner*—J. Reed Batten, Jr.
*Attorney, Agent, or Firm*—Thomas N. Ljungman

[57] ABSTRACT

The machine has a cooled and moving substrate, for example an endless horizontal belt, a feeding device, for example a tundish, and a distributor arranged transversely to the substrate for distributing liquid metal over the substrate. The distributor can have an outlet for permitting a stream of liquid metal to exit the distributor, into a gaseous medium which can be enclosed by a hood or cover, at a substantial angle from the horizontal and vertical axes of the distributor, and the pressure of the liquid metal at the outlet can also be varied.

27 Claims, 7 Drawing Sheets

13
14
17
20
31
18
15
29
40
41
28
26
25
24
21
27
12
12
12
11

MACHINE AND METHOD OF CONTINUOUSLY CASTING A METAL STRIP

CONTINUING APPLICATION DATA

This application is a Continuation-In-Part application of International Application No. PCT/SE92/00496, filed on Jul. 1, 1992, which claims priority from Swedish Patent Application No. 9102022.2, filed on Jul. 1, 1991. International Application No. PCT/SE92/00496 was pending as of the filing date of U.S. application Ser. No. 08/177,626 and the U.S. was an elected state in International Application No. PCT/SE92/00496.

This invention relates to a machine for casting metal strips, the machine comprising a cooled and moving substrate, for example an endless belt and a feeding device that comprises a tundish and a distributor for distributing the liquid metal over the substrate. The invention relates also to a method of casting a metal strip by supplying liquid metal to a cooled and moving substrate on which the metal solidifies. Most prior art machines of this kind are made to produce comparatively narrow strips. The wider the strip and the faster the casting, the more difficult the feeding of the liquid metal to the substrate will be because of the larger flow necessary.

The invention provides for an improved feeding of the liquid metal to the substrate and it will permit for a fast casting of the strip also when the strip is wide. The feeding is reliable and its control is fast. The starting of the casting will be fast and reliable.

The invention will be described with reference to the drawings.

Figure 4:
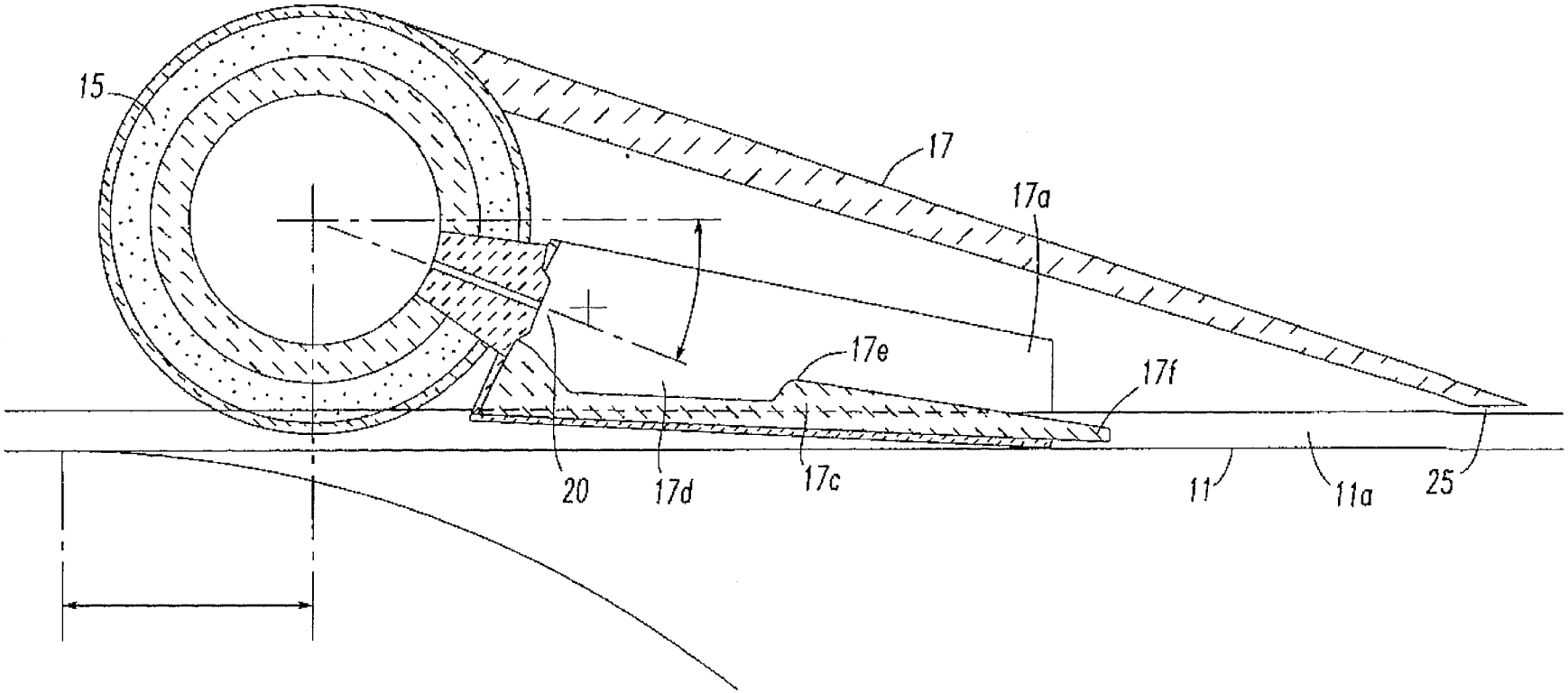
Figure 4A:
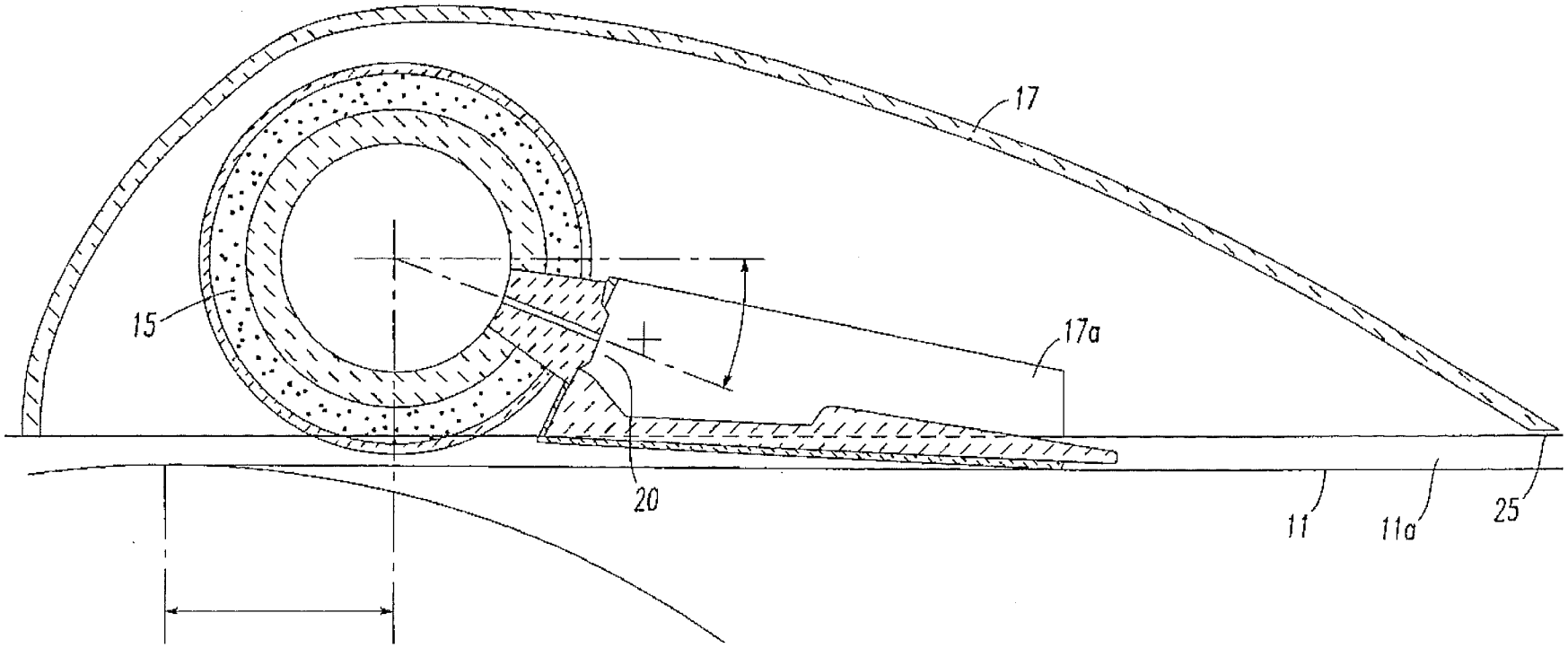

FIGS. 4 and 4*a* are cross-sectional views of two additional embodiments having two different types of hoods.

Figure 5:
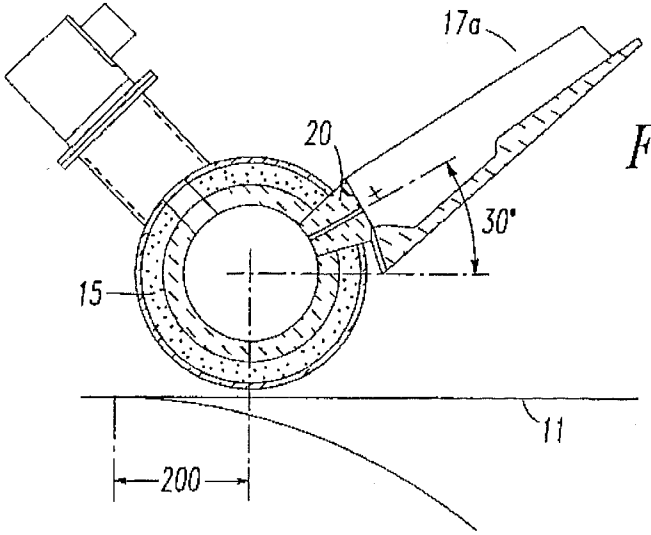

FIG. 5 shows a casting device similar to the embodiments of FIGS. 4 and 4*a*, in a preheating position.

Figure 6:
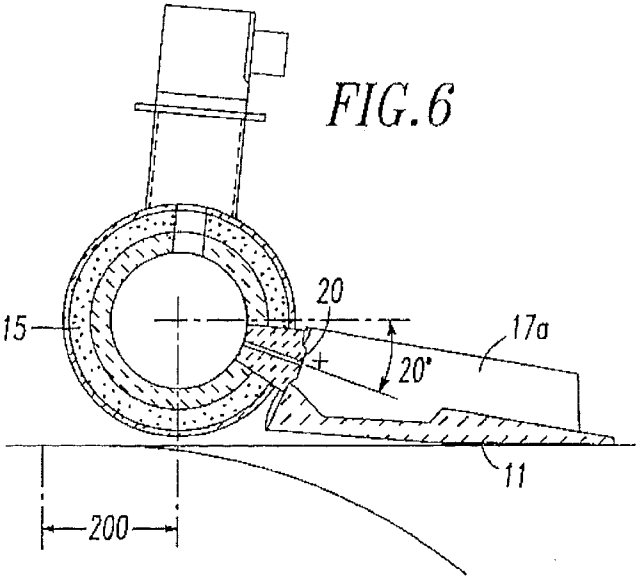

FIG. 6 shows a casting device similar to the embodiments of FIGS. 4 and 4*a*, in a casting position.

Figure 7:
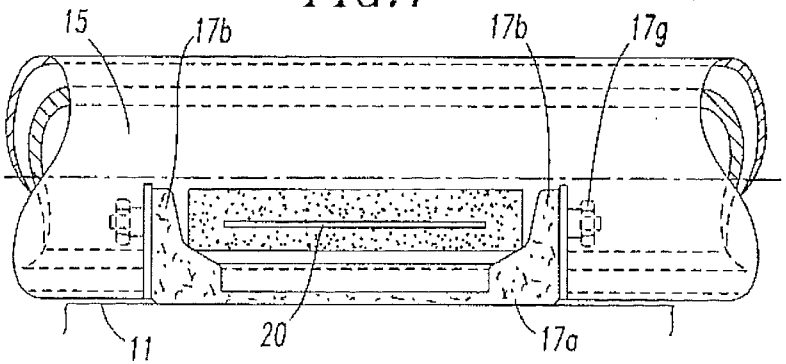

FIG. 7 shows a front view of the distributor and trough of an embodiment similar to FIGS. 4 and 4*a*.

Figure 3:
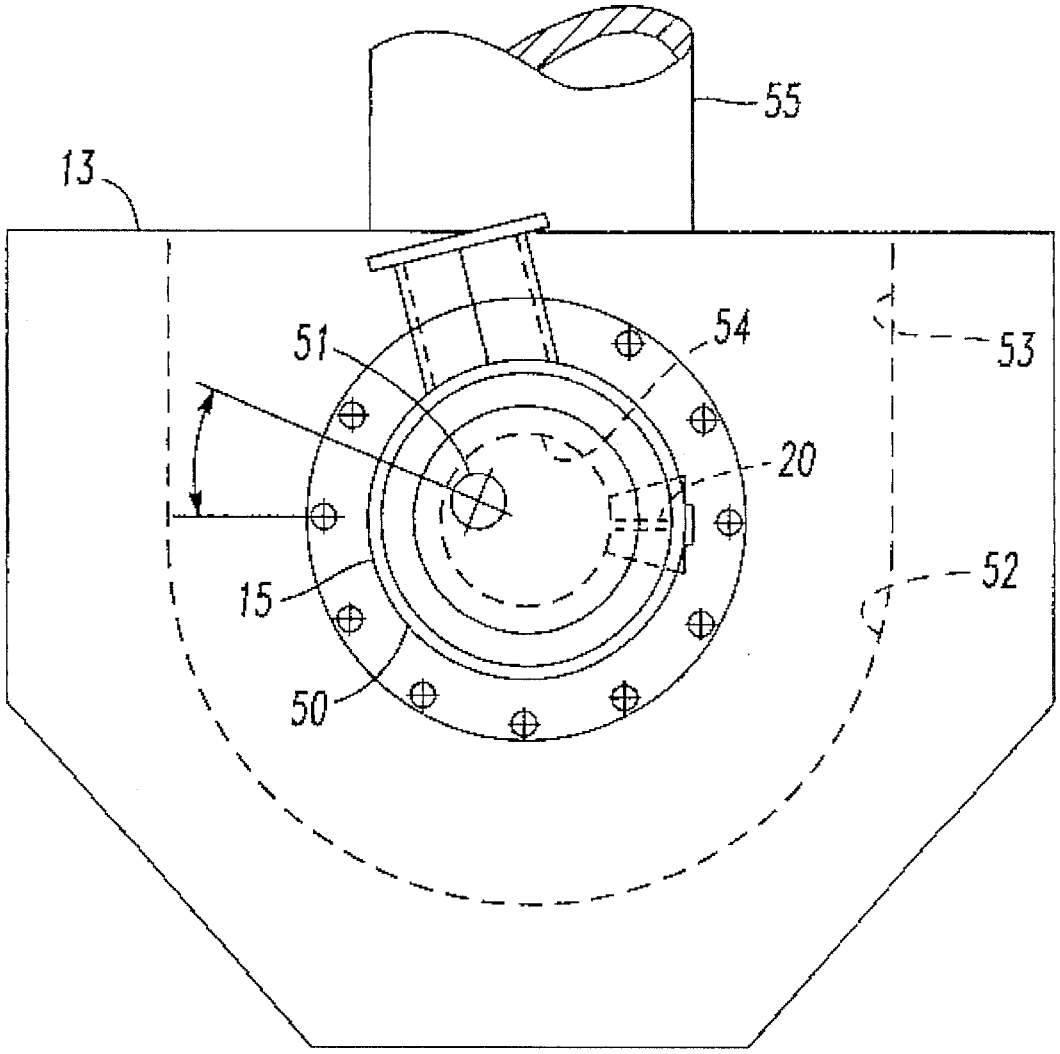
FIG. 3 is a fragmentary end view of a distributor which is modified with respect to a distributor shown in FIGS. 1 and 2.
Figure 8:
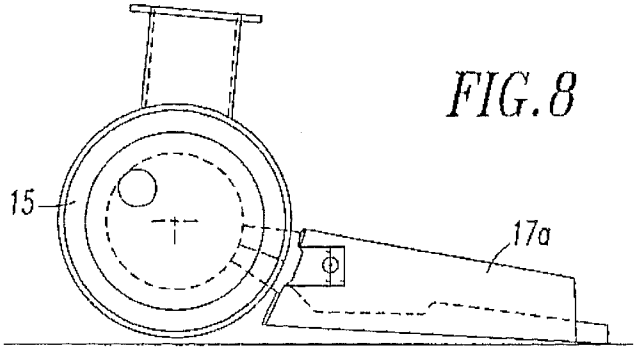

FIG. 8 shows a casting device similar to that shown in FIG. 3, in a casting position.

Figure 10:
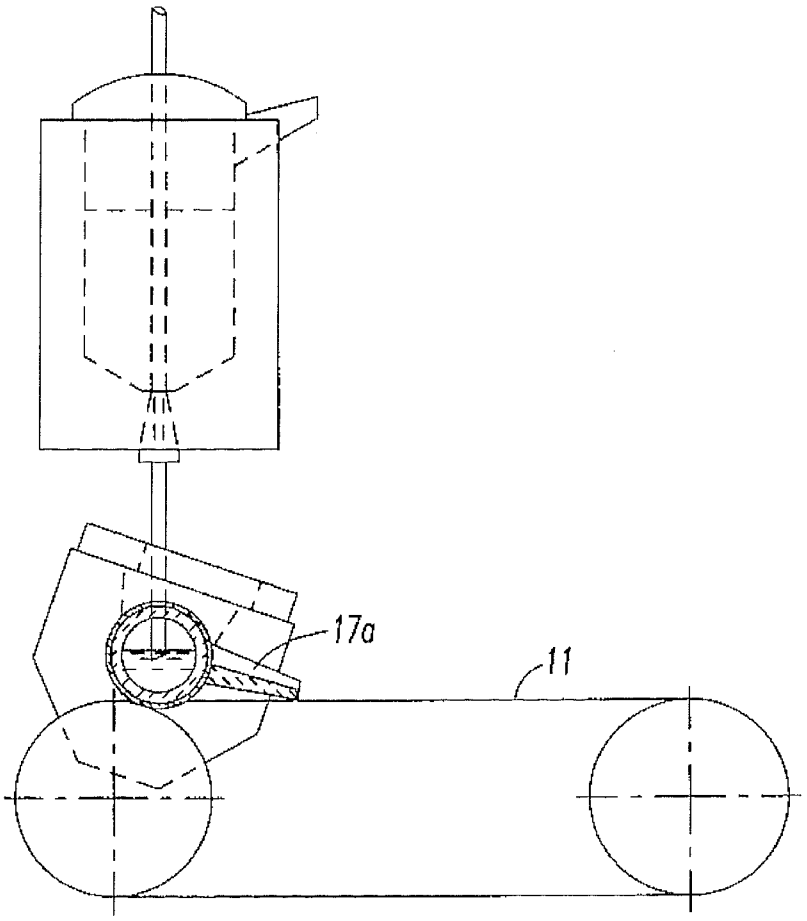
Figure 9:
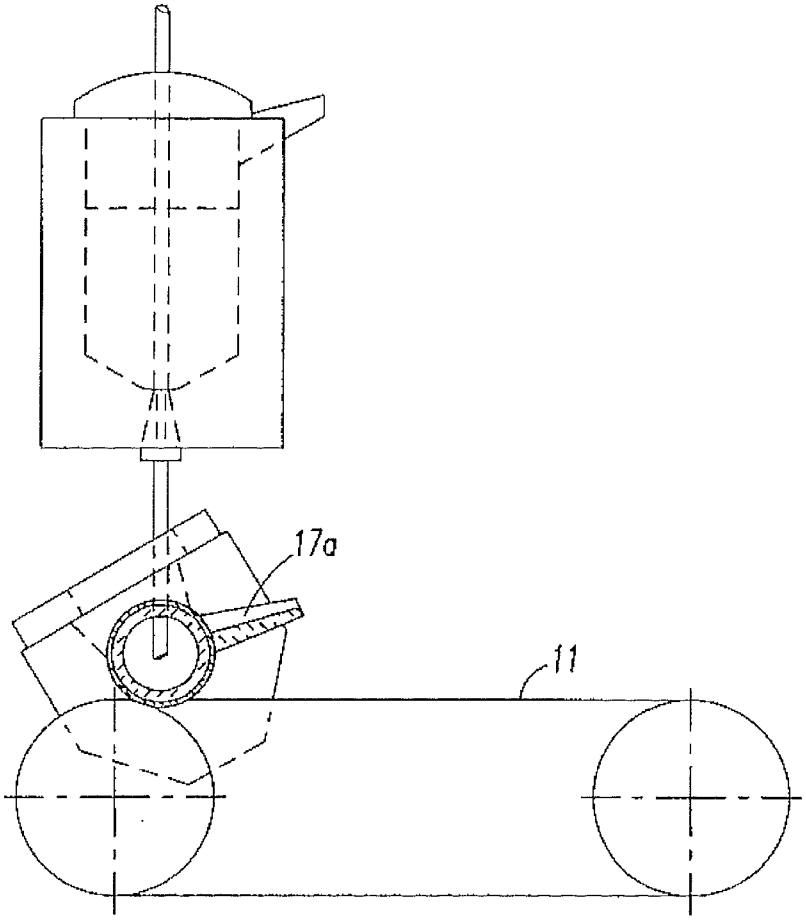

FIGS. 9 and 10 also show a casting device similar to that shown in FIG. 3, in a preheating position and in a casting position, respectively.

Figure 1:
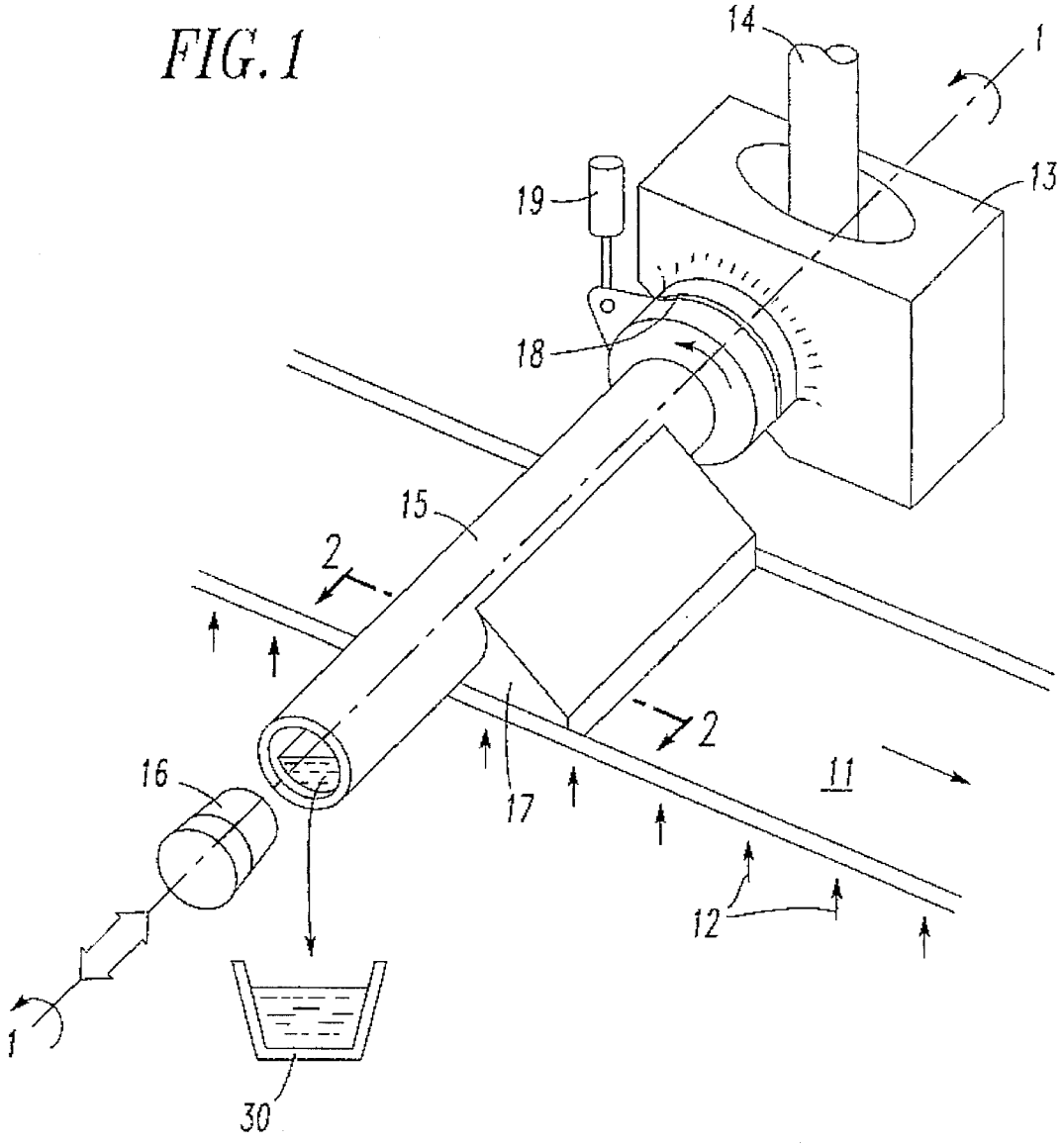
FIG. 1 is a fragmentary and schematic perspective view of a casting machine according to the invention.
Figure 2:
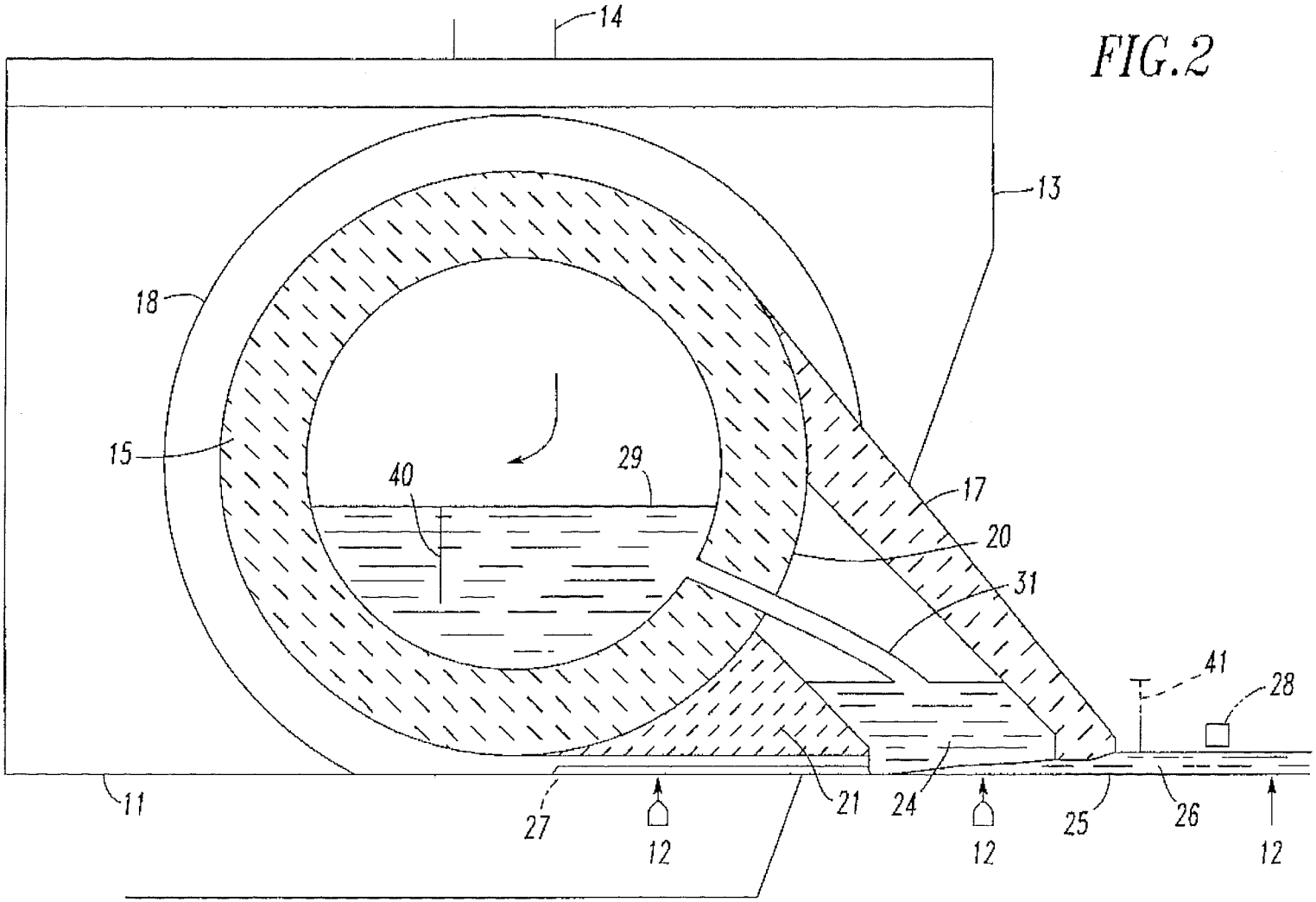
FIG. 2 is an enlarged fragmentary section taken along the line 2—2 in FIG. 1.

In FIGS. 1 and 2, parts of a strip casting machine are shown which are in accordance with the invention. The casting machine has a power driven substrate in the form of a horizontal or substantially horizontal endless steel belt 11, that runs on two rollers that are not shown. The belt need not be completely horizontal, it can be somewhat inclined, in particular, it can be inclined such that it runs somewhat upwardly in the direction of casting. The steel belt 11 is water cooled at its back by means of closely arranged nozzles 12 that spray water on the band 11. Only two of the numerous nozzles 12 are indicated. A feeding device consists of a tundish 13, a supply pipe 14 for supplying liquid-steel to the tundish 13, a tubular distributor 15 with a stopper 16 and a hood 17 supplied with a protective gas, for example an inert gas such as argon. Between the tundish 13 and the distributor 15, there is a coupling 18 that permits turning of the distributor about the longitudinal axis 1 of the distributor 15. The coupling 18 is made of the same material as conventional sliding gate valves of ladles. A turning device in the form of a hydraulic cylinder 19 is arranged to turn the distributor relative to the tundish 13.

FIG. 2 is an enlarged transverse section taken along line 2—2 in FIG. 1 and it shows the steel belt 11, the distributor tube 15, the hood 17 and the tundish 13. The ceramic distributor tube 15 has a side outlet 20 that extends over the entire width of the steel belt 11. The side outlet 20 consists of a large number of discrete openings, but it could also be a single slot. The flow velocity in the longitudinal direction of the distributor tube 15 should not be too high since it could then disturb the flow through the outlet.

The distance between the openings 20 and/or the diameter of the holes can be adapted to give an evenly distributed outlet flow along the distributor tube 15, that is along the width of the steel belt 11. The interior cross sectional area of the distributor pipe 15 should be 3 times, preferably 5 times, as great as the total area of the outlet holes 20. The openings 20 could preferably be conically narrower towards their outlet end in order to provide for a more stable stream.

The distributor tube 15 is journaled against the ceramic hood 17 and against a fixed ceramic sealing element 21. A pool 24 of liquid steel is formed between the ceramic hood 17 and the ceramic sealing element 21. The liquid steel flows through the protective argon gas into the pool 24. The hood 17 has a clearance 25 to the steel belt 11 through which the liquid steel flows and forms a thin layer 26 on the belt 11. Since the underside of the endless steel belt is heavily cooled, the solidification begins already in the pool 24. A lubricant, that can be a conventional casting powder with low melting point, is supplied behind the sealing element 21 and fills the clearance between the sealing element 21 and the steel belt 11 in order to prevent air from being sucked through the clearance. The thickness of the clearance and the casting powder is exaggerated in the Figure and have been given the common reference 27.

The casting machine is only schematically shown and necessary edges along the sides of the steel belt 11 are not shown. They may be in the form of chains, wires or ropes that moves with the steel belt.

The thickness of the cast strip 26 is monitored by a sensor 28, the output signal of which controls, via an automatic control equipment, the hydraulic cylinder 19 that turns the distributor 15. The level 29 of the liquid steel in the distributor and in the tundish is the same and it is maintained constant by means of a conventional level control equipment and the tolerance is conventionally one or a few millimeters.

The hydrostatic height 40 that drives the flow out of the outlets 20 of the distributor center is varied by the turning of the distributor 15, and a change of this flow will change the height of the pool 24 which is the hydrostatic height 40 that drives the flow out of the clearance 25 between the hood 17 and the steel belt 11.

Thus, simply by automatically controlling the turning of the distributor 15 in response to the actual thickness of the cast steel strip 26 one can control the thickness of the cast steel strip 26 provided that the other parameters such as the level in the tundish 13, the width of the clearance 25, and the velocity of the steel belt 11 are maintained constant. The height of the pool 24 can for example be 40–60 mm and the height of the clearance 25 can be 5–7 mm.

The described feeding device is simple and its cost of investment is low. Since the consumable parts are small, the operation cost will also be low. The automatic control during operation will be rapidly responding, accurate and reliable, and it will be so also when the production is high.

Before starting the casting, the operator preheats the tundish 13 and the distributor 15 with a burner. The stopper 16 is then removed as shown in FIG. 1. By having liquid steel flowing through the distributor to a vessel 30, the operator carries out the final preheating of the distributor. During the preheating the distributor is turned so that its outlet 20 is directed upwardly, that is, it is above the level of the flowing liquid steel in the distributor 15. When the distributor 15 has been preheated, its open end is closed by the stopper 16 and when the distributor is then turned so that its outlet 20 is below the level of the liquid steel in the distributor, the casting starts. The starting is fast and a steady state is reached very quickly.

In the embodiment described above with reference to FIGS. 1 and 2, the tundish 13, the hood 17 and the sealing element 21 are fixed and only the distributor 15 is turnable. In FIG. 3, a modified embodiment is shown in a view seen from the end of the distributor 15. There is no stopper 16, but there is a fixed end wall 50 of the distributor 15. The end wall 50 has an opening 51. The interior wall 52 of the ceramic lining of the tundish 13 is semi circular in cross section and its axis is common to the axis of the tubular distributor 15 which is also circular in cross section. The walls 53 of the upper part of the tundish are parallel. The interior wall of the tubular ceramic lining of the distributor 15 has been given reference 54. There is no coupling 18, but the tundish 13 and the distributor 15 are fixed together and are turnable as a unit. For the final preheating of the distributor 15, the distributor 15 and tundish 13 are turned so that the liquid steel will pass through the opening 51, while the side openings 20 will be above the level of the liquid steel in the distributor. Then, when the distributor 15 and tundish 13 are turned so that the opening 51 will be above the level of liquid steel and the row of side openings 20 will be below the level of liquid steel, the contiuous casting will begin. Since the bottom of the tundish is semi circular, the level of liquid steel will not change because of the turning. The wide opening of the tundish 13 permits for about 45° turning even though the pipe 14 is fixed. Such an angle of turning will suffice both for the preheating and for the control during casting since the level of liquid steel can be maintained at or below the center of the distributor 15. In FIG. 3, a fitting 55 is shown on the distributor 15 for a laser sensor for sensing the level of the liquid steel directly in the distributor 15. The laser sensor is part of a conventioned level control equipment for maintaining the level constant in the tundish 13 and distributor 15.

The outlets 20 are shown radially directed in FIG. 3 but are shown somewhat upwardly directed with respect to a radius in FIG. 2. The upward direction is advantageous since it makes it possible to have a lower hydraulic height that drives the outlet flow through the outlets 20.

The casting machine described is primarily intended for casting a steel strip with a width of up to 2 m and a thickness of up to 10 mm. It can, however, be designed for other methods and other strip sizes.

Alternative embodiments of the present invention are shown in FIGS. 4 through 10. It is believed that this embodiment may be a better mode of use than the embodiments shown in FIGS. 1, 2, and 3. The embodiment as shown in FIG. 4 may feature an enlarged hood 17, which hood 17 is preferably ceramic. The hood 17 is analogous to the ceramic hood 17 featured in FIGS. 1 and 2. The hood 17 may extend from the outer surface of the distributor 15 to the belt 11. An opening 25 is preferably disposed between the hood 17 and the belt 11, to preferably allow the steel strip product to exit from the hood 17. The hood 17 is preferably filled with argon gas, as in the embodiment shown in FIGS. 1 and 2. In addition, the hood 17 preferably extends over the belt 11 area far enough to allow the preferably steel strip product to solidify on the belt 11. The hood 17 preferably has a length of about 2 meters in this embodiment. In addition, the distributor 15 preferably has a diameter of about 30 to 40 centimeters.

The embodiment shown in FIG. 4 may also feature a trough 17*a*, which trough 17*a* may be operatively attached near the outlet hole or holes 20. The trough 17*a* preferably has two preferably parallel sidewalls 17*b*, as best shown in FIG. 7. The trough 17*a* is preferably open at the top, and is preferably constructed of a ceramic or refractory material. The trough 17*a* preferably has a sloped bottom 17*c*, and the flow of liquid metal preferably flows along the sloped bottom 17*c* after exiting the hole or holes 20. The sloped bottom 17*c* may extend out past the sides of the trough 17*a*. The sloped bottom 17*c* preferably has a pool 17*d*, which pool 17*d* is similar in function to the pool 24 shown in FIGS. 1 and 2. The pool 17*d* may serve to calm down the flow of liquid metal once the flow exits the hole or holes 20.

Thus, the liquid preferably exits the hole or holes 20, may flow onto the sloped bottom 17*c* of the trough 17*a*, and into the pool 17*d*. When the liquid which has preferably accumulated in the pool 17*d* has reached the peak 17*e*, the liquid then preferably flows along the remaining length of the sloped bottom 17*c*, out of the trough 17*a*. The liquid then may flow over the end portion 17*f* of the sloped bottom 17*c*, and then preferably on to the belt 11.

The embodiment shown in FIG. 4, as well as the embodiments shown in FIGS. 1, 2, and 3, may have a belt 11 which may be comprised of copper. There may also be sidewalls 11*a* which may run along the sides of the belt 11. The sidewalls 11*a* may preferably aid in forming or shaping the metal strip product.

In an additional alternative embodiment, as shown in FIG. 4*a*, the hood 17 may be constructed to fit completely over the distributor 15. the hood 17 may then preferably extend to meet the belt 11 as in FIG. 4, leaving an opening 25 for the product to exit the hood 17. The hood 17 in this embodiment, as well as in all of the other embodiments, may form at least a partial seal against the metal strip product.

FIG. 5 shows the embodiment of FIG. 4 in a preheating position. During the preheating phase, the distributor 15 is preheated by preferably removing the stopper 16 from the end of the distributor 15 and allowing the liquid metal to flow through the length of the distributor 15. During the preheating phase, the distributor 15 may be preferably rotated or turned upwards so that the hole or holes 20 are preferably above the level of liquid in the distributor 15. At the end of the preheating phase, the stopper 16 is preferably inserted back into the end of the distributor 15, and the distributor 15 is preferably rotated or turned downwards, so that the hole or holes 20 will preferably be below the level of liquid metal in the distributor 15 to preferably begin the casting phase. FIG. 6 shows the embodiment of FIG. 4 while in a casting position.

FIG. 7 shows a front view of the distributor 15 and the trough 17*a* of the embodiment shown in FIG. 4. The trough 17*a* may preferably have hinges 17*g* disposed on each side of the trough 17*a*. The hinges 17*g* may serve to permit the distributor 15 to move independently of the trough 17*a*.

The embodiment shown in FIGS. 4–10 also may include various features of the embodiments shown in FIGS. 1, 2, and 3. These features, which are not shown in FIGS. 4–10 may include: nozzles 12 which nozzles 12 may serve to cool the belt 11; a hydraulic cylinder 19 to preferably turn the distributor 15; a sensor 28 to preferably measure the thickness of the cast strip product; and a laser sensor and a fitting for a laser sensor 55 to preferably measure the level of liquid in the tundish 13.

In all of the embodiments, the temperature of the melt, and the speed of the belt 11, as well as other parameters, may be adjusted in order to achieve the desired end product.

One feature of the invention resides broadly in the machine for the continuous casting of a metal strip, comprising a cooled and moved substrate, for example an endless belt (11), and a feeding device that comprises a tundish (13) and a distributor (15) for distributing the liquid metal over the substrate, characterized in that the distributor (15) is substantially tube-formed and arranged transverse to the substrate (11) and has a side outlet (20) that extends along the distributor (15).

Another feature of the invention resides broadly in the machine, characterized in that the feeding device comprises means (18, 19, 28) for varying the hydrostatic height of the liquid metal above the side outlet (20).

Still another feature of the invention resides broadly in the machine, characterized in that the means for varying the hydrostatic height of the liquid metal above the side outlet (20) comprises a means (18, 19, 28) for rotating the distributor (15).

Yet still another feature of the invention resides broadly in the machine, characterized by walls (17, 21) that defines a pool (24) that is formed by the liquid metal flowing out of the side outlet (20), the walls (17, 21) having a clearance to the substrate that forms an outlet slot (25), the height of the pool being several times the width of the slot (25).

Still yet another feature of the invention resides broadly in the machine, characterized in that the interior cross-section area of the distributor (15) is at least three times, preferably at least five times as great as the area of the side outlet (20).

Yet still another feature of the invention resides broadly in the machine, characterized in that the side outlet (20) comprises a number of discrete outlet holes (20).

Still yet another feature of the invention resides broadly in that the machine, characterized in that during casting the distributor (15) is only partly filled with liquid metal.

Yet still another feature of the invention resides broadly in that the machine, characterized by means for sensing the level of liquid metal directly in the distributor (15).

Still yet another feature of the invention resides broadly in the method of continuously casting a metal strip by supplying liquid metal to a cooled and moving substrate, for example an endless belt (11) on which the metal solidifies, characterized in that the liquid metal is distributed through a side outlet (20) of a distributor (15) that is substantially tubular and extends transversely to the substrate (11), and that before the starting of the casting, the distributor (15) is preheated by liquid steel flowing through it while not reaching the level of the side outlet (20).

Yet still another feature of the invention resides broadly in the method, characterized in that the casting is started by the turning of the distributor such that its side outlet (20) will be below the level of the liquid metal.

Still yet another feature of the invention resides broadly in the method, characterized in that the casting is started and the preheating is ended by the turning of the distributor (15) such that an outlet at the end of the distributor (15) will be raised from the liquid metal and the side outlet (20) will be lowered into the liquid metal.

Yet still another feature of the invention resides broadly in the method, characterized in that the liquid metal flowing out of the side outlet (15) forms a pool (24) against the substrate (11) and the liquid metal passes the bottom of the pool through a clearance (25) formed against the substrate while the pool is maintained several times as high as the clearance (25).

Types of continuous casting devices may be disclosed in the following patents: U.S. Pat. No. 5,257,659 to Maag on Nov. 2, 1993, entitled "Continuous Casting Mold"; U.S. Pat. No. 5,238,049 to Martin on Aug. 24, 1993, entitled "Adjustable Flow Control Device for Continuous Casting of Metal Strip"; U.S. Pat. No. 5,191,925 to Sosin on Mar. 9, 1993, entitled "Roll for a Device for the Direct Continuous Casting of Thin Strips of Molten Metal"; U.S. Pat. No. 5,137,075 to Gerding on Aug. 11, 1992, entitled "Continuous Casting Apparatus and Method"; U.S. Pat. No. 5,127,557 to Bruckner on Jul. 7, 1992, entitled "Shut-off and Control Valve for Use in Continuous Casting of a Thin Strip or Slab"; U.S. Pat. No. 5,074,353 to Ohno on Dec. 24, 1991, entitled "Method for Horizontal Continuous Casting of Metal Strip and Apparatus Therefor"; U.S. Pat. No. 4,982,779 to Nagai et al. on Jan. 8, 1991, entitled "Shut-off Device for Use in a Guide Conduit of a Horizontal Continuous Casting Apparatus"; U.S. Pat. No. 5,118,084 to Paulus et al. on Jun. 2, 1992, entitled "Apparatus for Controlled Adjustment of a Stopper of a Distributor Channel or the Like in a Continuous Casting Plant"; U.S. Pat. No. 4,791,978 to Fishler on Dec. 20, 1988, entitled "Gas Permeable Stopper Rod"; U.S. Pat. No. 5,242,014 to Takahashi et al. on Sep. 7, 1993, entitled "Continuous Casting Method and Apparatus for Implementing Same Method"; U.S. Pat. No. 4,787,438 to Flemming et al. on Nov. 29, 1988, entitled "Method and Apparatus for Continuously Casting Metal"; and U.S. Pat. No. 4,660,619 to Nettelbeck et al. on Apr. 28, 1987, entitled "Mold Cooling Apparatus and Method for Continuous Casting Machines".

Additional types of continuous casting devices may be disclosed in the following patents: International Patent No. WO-A1-8802288 published on Apr. 7, 1988, and the corresponding U.S. Pat. No. 4,913,219 published on Apr. 3, 1990; German Patent No. DE-B-2213111 published on Dec. 12, 1974, and the corresponding U.S. Pat. No. 3,794,106 published on Feb. 26, 1974; German Patent No. DE-A-2058618 published on Jun. 24, 1971, and the corresponding U.S. Pat. No. 3,645,322 published on Feb. 29, 1972; and U.S. Pat. No. 1,612,737 published on Dec. 28, 1926.

All, or substantially all, of the components and methods of the various embodiments may be used with at least one embodiment or all of the embodiments, if any, described herein.

All of the patents, patent applications and publications recited herein are hereby incorporated by reference as if set forth in their entirety herein.

The corresponding foreign and international patent publication applications, namely, Swedish Patent Application No. SE 9102022, and PCT/SE92/00496, filed on Jul. 1, 1991 and Jul. 1, 1992, respectively, having inventors. Lars Gunnar Johansson and Ralph Nyström, and the corresponding Swedish Laid Open Patent Application, and the corresponding Swedish Patent, as well as their published equivalents, are hereby incorporated by reference as if set forth in their entirety herein.

The appended drawings in their entirety, including all dimensions, proportions and/or shapes in at least one embodiment of the invention, are accurate and to scale and are hereby included by reference into this specification.

The invention as described hereinabove in the context of the preferred embodiments is not to be taken as limited to all of the provided details thereof, since modifications and variations thereof may be made without departing from the spirit and scope of the invention.

We claim:

1. A machine for the continuous casting of a metal strip, said machine comprising:

means for moving and cooling metal strip disposed in a substantially horizontal direction;

said means for moving and cooling metal strip having a direction of movement;

means for pouring molten metal to be received by said means for moving and cooling metal strip;

said pouring means having a vertical axis, a horizontal axis, a longitudinal axis and at least one side;

said longitudinal axis of said pouring means being disposed in a direction to form an angle with said direction of movement of said means for moving and cooling;

said pouring means comprising:

outlet means for permitting the exit of molten metal from said pouring means;

said outlet means being disposed on at least a portion of said at least one side of said pouring means;

said outlet means comprising exit means for permitting a stream of molten metal to exit said outlet means at a substantial angle from said horizontal axis and a substantial angle from said vertical axis;

said angle from said vertical axis being substantially larger than said angle from said horizontal axis;

means for varying said angle from said vertical axis and said angle from said horizontal axis of the stream of molten metal;

means for feeding molten metal to be received by said pouring means;

said means for varying comprising one of the following sets of features a) and b):

a) coupling means for permitting said pouring means to rotate independently of said feeding means;

hydraulic cylinder means for rotating said pouring means;

sensor means for sensing the thickness of the metal strip moving along said means for moving and cooling metal strip;

said sensor means having means for sending a signal to said hydraulic cylinder means to rotate said pouring means based on the sensed thickness of the metal strip; and b) means for attaching said pouring means to said feeding means;

means for rotating said pouring means and said feeding means together as a unit;

sensor means for sensing the thickness of the metal strip moving along said means for moving and cooling metal strip; and said sensor means having means for sending a signal to said rotating means to rotate said pouring means and said feeding means based on the sensed thickness of the metal strip.

2. The machine according to claim 1 wherein:

said pouring means has an interior surface and an exterior surface;

said pouring means has a first point and a second point;

said second point is disposed on said longitudinal axis;

said first point is disposed away from said second point;

said first point is disposed between said second point and said interior surface;

said exit means extends radially from said interior surface to said exterior surface in a direction substantially in alignment with said first point;

said angle from said vertical axis is about 70° with respect to said vertical axis;

said means for varying further comprises means for varying the pressure of the molten metal at said outlet means;

said means for varying the pressure comprises means for varying the hydrostatic height of the molten metal to vary the pressure of the molten metal at said outlet means;

said exit means comprises means for pouring the stream of molten metal into a gaseous medium which is in the environs of said outlet means;

said machine further comprises:

means for receiving and guiding the stream of molten metal, having exited into the gaseous medium, from said exit means to said means for moving and cooling metal strip;

said receiving means comprises one of the following sets of features c) and d):

c) said means for receiving comprises a first wall portion and a second wall portion disposed a distance from one another, the stream of molten metal forming a pool between said first wall portion and said second wall portion, said pool having a height;

said first wall portion is disposed between said pouring means and said means for moving and cooling metal strip, said first wall portion and said second wall portion forming a clearance with said means for moving and cooling metal strip, said clearance having a height extending from said means for moving and cooling metal strip to said first wall portion; and said first wall portion and said second wall portion are configured such that said height of said pool is at least two times as great as said height of said clearance; and d) said receiving means is disposed to contact at least a portion of said exit means;

said means for receiving comprises:

a bottom portion and first and second side portions;

said bottom portion having a first side and a second side disposed opposite from one another;

said bottom portion is disposed in a direction substantially parallel to said moving and cooling means;

said first side portion is disposed along said first side of said bottom portion and said second side is disposed along said second side of said bottom portion to form a U shape;

said bottom portion comprises an indented portion configured for allowing molten metal exiting from said exit means to accumulate in said indented portion and to calm;

said bottom portion further comprises a raised portion disposed adjacent said indented portion, said raised portion being configured for permitting the molten metal to move onto said means for moving and cooling metal strip;

said machine further comprising:

means for covering, said means for covering for covering at least over said outlet means, said means for covering defining a space with respect to said moving and cooling means, said space containing a gaseous medium;

said covering means comprises one of the following sets of features e) and f):

e) said covering means comprises a portion extending from said pouring means towards said means for moving and cooling metal strip;

said portion being disposed at an angle with respect to said means for moving and cooling metal strip;

said portion having a first end and a second end;

said first end is disposed adjacent said pouring means;

said second end is disposed to form a clearance with said means for moving and cooling metal strip;

said means for receiving being disposed within said covering means; and f) said covering means comprises a portion surrounding at least said pouring means and said means for receiving and guiding;

said portion having a first end and a second end;

said first end is disposed adjacent said means for moving and cooling metal strip; and said second end is disposed adjacent said means for moving and cooling metal strip, at a predetermined distance from said first end;

said means for varying further comprises means for sensing and for controlling the level of molten metal in said pouring means based on the sensed level of molten metal in said pouring means;

said pouring means further comprises a substantially tubular shape;

said pouring means is disposed in a direction substantially perpendicular to said direction of movement;

said pouring means further comprises one of the following sets of features g) and h);

g) a first end and a second end;

said first end being disposed adjacent said feeding means;

said second end being disposed axially away from said first end;

said second end comprising orifice means for permitting molten metal to exit said pouring means substantially only during preheating of said pouring means;

stopper means for being inserted into said orifice means after the preheating of said pouring means; and h) a first end and a second end;

said first end being disposed adjacent said feeding means;

said second end being disposed axially from said first end;

said second end comprising an end wall portion;

said end wall portion being configured to prevent the flow of molten metal from said pouring means during casting;

said end wall portion comprising orifice means for permitting the exit of molten metal from said pouring means substantially only during preheating of said pouring means;

said machine further comprising:

means for controlling the velocity of said moving and cooling means;

pipe means for supplying molten metal to said feeding means;

said means for moving and cooling comprises a plurality of nozzles disposed along said means for moving and cooling metal strip;

said plurality of nozzles are configured for spraying a cooling substance towards the metal strip moving along said means for moving and cooling metal strip;

said exit means comprises a plurality of outlet holes;

said outlet means comprises a total area; and said pouring means has an interior area, said interior area of said pouring means is one of:

at least three times; and at least five times greater than said total area of said outlet means.

3. A machine for the continuous casting of a metal strip, said machine comprising:

means for moving and cooling metal strip disposed in a horizontal direction;

said means for moving and cooling metal strip having a direction of movement;

means for pouring molten metal to be received by said means for moving and cooling metal strip;

said pouring means having a longitudinal axis and at least one side;

said longitudinal axis of said pouring means being disposed in a direction to form an angle with said direction of movement of said means for moving and cooling;

said pouring means comprising:

outlet means for permitting the exit of molten metal from said pouring means;

said outlet means being disposed on at least a portion of said at least one side of said pouring means; and means for varying the pressure of the molten metal at said outlet means.

4. The machine according to claim 3 wherein said means for varying the pressure comprises means for varying the hydrostatic height of the molten metal to vary the pressure of the molten metal at said outlet means.

5. The machine according to claim 4 wherein:

said pouring means is mounted for rotation; and said means for varying the hydrostatic height comprises means for rotating said pouring means.

6. The machine according to claim 5 wherein:

said machine further comprises means for feeding molten metal to be received by said pouring means;

said means for rotating comprises one of the following sets of features a) and b):

a) coupling means for permitting said pouring means to rotate independently of said feeding means;

hydraulic cylinder means for rotating said pouring means;

sensor means for sensing the thickness of the metal strip moving along said means for moving and cooling metal strip;

said sensor means having means for sending a signal to said hydraulic cylinder means to rotate said pouring means based on the sensed thickness of the metal strip; and b) means for attaching said pouring means to said feeding means;

means for rotating said pouring means and said feeding means together as a unit;

sensor means for sensing the thickness of the metal strip moving along said means for moving and cooling metal strip; and said sensor means having means for sending a signal to said rotating means to rotate said pouring means and said feeding means based on the sensed thickness of the metal strip.

7. The machine according to claim 6 wherein:

said pouring means has a vertical axis and a horizontal axis;

said outlet means comprises exit means for permitting a stream of molten metal to exit said outlet means at a substantial angle from said horizontal axis and a substantial angle from said vertical axis;

said angle from said vertical axis is substantially larger than said angle from said horizontal axis;

said means for varying the hydrostatic height further comprises means for varying said angle from said vertical axis and said angle from said horizontal axis of the stream of molten metal;

said angle from said vertical axis is about 70°;

said pouring means has an interior surface and an exterior surface;

said pouring means has a first point and a second point;

said second point is disposed on said longitudinal axis;

said first point is disposed away from said second point;

said first point is disposed between said second point and said interior surface;

said exit means extends radially from said interior surface to said exterior surface in a direction substantially in alignment with said first point;

said exit means comprises means for pouring the stream of molten metal into a gaseous medium which is in the environs of said outlet means;

said machine further comprises:

means for receiving and guiding the stream of molten metal, having exited into the gaseous medium, from said exit means, to said means for moving and cooling metal strip;

said receiving means comprises one of the following sets of features c) and d):

c) said means for receiving comprises a first wall portion and a second wall portion disposed a distance from one another, the stream of molten metal forming a pool between said first wall portion and said second wall portion, said pool having a height;

said first wall portion is disposed between said pouring means and said means for moving and cooling metal strip, said first wall portion and said second wall portion forming a clearance with said means for moving and cooling metal strip, said clearance having a height extending from said means for moving and cooling metal strip to said first wall portion; and said first wall portion and said second wall portion are configured such that said height of said pool is at least two times as great as said height of said clearance; and d) said receiving means is disposed to contact at least a portion of said exit means;

said means for receiving comprises:

a bottom portion and first and second side portions;

said bottom portion having a first side and a second side disposed opposite from one another;

said bottom portion is disposed in a direction substantially parallel to said means for moving and cooling metal strip;

said first side portion is disposed along said first side of said bottom portion and said second side is disposed along said second side of said bottom portion to form a U shape;

said bottom portion comprises an indented portion configured for allowing molten metal exiting from said exit means to accumulate in said indented portion and to calm; and said bottom portion further comprises a raised portion disposed adjacent said indented portion, said raised portion being configured for permitting the molten metal to move onto said means for moving and cooling metal strip;

said machine further comprising:

means for covering, said means for covering for covering at least over said outlet means said means for covering defining a space with respect to said moving and cooling means, said space containing a gaseous medium;

said covering means comprises one of the following sets of features e) and f):

e) said covering means comprises a portion extending from said pouring means towards said means for moving and cooling metal strip;

said portion being disposed at an angle with respect to said means for moving and cooling metal strip;

said portion having a first end and a second end;

said first end is disposed adjacent said pouring means;

said second end is disposed to form a clearance with said means for moving and cooling metal strip;

said means for receiving being disposed within said covering means; and f) said covering means comprises a portion surrounding at least said pouring means and said means for receiving and guiding;

said portion having a first end and a second end;

said first end is disposed adjacent said means for moving and cooling metal strip;

said second end is disposed adjacent said means for moving and cooling metal strip, at a predetermined distance from said first end;

said means for varying further comprises means for sensing and for controlling the level of molten metal in said pouring means based on the sensed level of molten metal in said pouring means;

said pouring means further comprises a substantially tubular shape;

said pouring means is disposed in a direction substantially perpendicular to said direction of movement;

said pouring means further comprises one of the following sets of features g) and h);

g) a first end and a second end;

said first end being disposed adjacent said feeding means;

said second end being disposed axially away from said first end;

said second end comprising orifice means for permitting molten metal to exit said pouring means substantially only during preheating of said pouring means;

stopper means for being inserted into said orifice means after the preheating of said pouring means; and h) a first end and a second end;

said first end being disposed adjacent said feeding means;

said second end being disposed axially away from said first end;

said second end comprising an end wall portion;

said end wall portion being configured to prevent the flow of molten metal from said pouring means during casting;

said end wall portion comprising orifice means for permitting the exit of molten metal from said pouring means substantially only during preheating of said pouring means;

said machine further comprising:

means for controlling the velocity of said moving and cooling means;

pipe means for supplying molten metal to said feeding means;

said means for moving and cooling metal strip comprises a plurality of nozzles disposed along said means for moving and cooling metal strip;

said plurality of nozzles are configured for spraying a cooling substance towards the metal strip moving along said means for moving and cooling metal strip;

said exit means comprises a plurality of outlet holes;

said outlet means comprises a total area; and said pouring means has an interior area, said interior area of said pouring means is one of: at least three times; and at least five times; greater than said total area of said outlet means.

8. The machine according to claim 5 wherein:

said machine further comprises means for feeding molten metal to be received by said pouring means;

said means for rotating comprises:

sensor means for sensing the thickness of the metal strip moving along said means for moving and cooling metal strip; and said sensor means having means for sending a signal to said rotating means to rotate said pouring means and said feeding means based on the sensed thickness of the metal strip.

9. A machine for the continuous casting of a metal strip, said machine comprising:

means for moving and cooling metal strip disposed in a substantially horizontal direction;

said means for moving and cooling metal strip having a direction of movement;

means for pouring molten metal to be received by said means for moving and cooling metal strip;

said means for pouring having a longitudinal axis;

said longitudinal axis of said means for pouring being disposed in a direction to form an angle with said direction of movement of said means for moving and cooling metal strip;

said means for pouring comprising:

outlet means for permitting the exit of molten metal from said pouring means;

said outlet means being disposed on at least a portion of said pouring means;

said outlet means comprising exit means for pouring a stream of molten metal into a gaseous medium which is in the environs of said outlet means;

means for receiving and guiding a stream of molten metal, having exited into the gaseous medium from said exit means, to said means for moving and cooling metal strip;

said receiving means being disposed to contact at least a portion of said exit means;

said means for receiving comprising:

a bottom portion and first and second side portions;

said bottom portion having a first side and a second side disposed opposite from one another;

said bottom portion being disposed in a direction substantially parallel to said moving and cooling means;

said first side portion being disposed along said first side of said bottom portion and said second side being disposed along said second side of said bottom portion to form a U shape;

said bottom portion comprising an indented portion configured for allowing molten metal exiting from said exit means to accumulate in said indented portion and to calm;

said bottom portion further comprising a raised portion disposed adjacent said indented portion, said raised portion being configured for permitting the molten metal to move onto said means for moving and cooling metal strip.

10. The machine according to claim 9 wherein:

said pouring means has a vertical axis, a horizontal axis, and at least one side;

said outlet means is disposed on at least a portion of said at least one side of said pouring means;

said exit means comprises means for permitting the stream of molten metal to exit said outlet means at a substantial angle from said horizontal axis and a substantial angle from said vertical axis, said angle from said vertical axis being substantially larger than said angle from said horizontal axis;

said machine further comprises means for varying said angle from said vertical axis and said angle from said horizontal axis of the stream of molten metal;

said machine further comprises means for feeding molten metal to be received by said pouring means;

said means for varying comprises one of the following sets of features a) and b):

a) coupling means for permitting said pouring means to rotate independently of said feeding means;

hydraulic cylinder means for rotating said pouring means;

sensor means for sensing the thickness of the metal strip moving along said means for moving and cooling metal strip;

said sensor means having means for sending a signal to said hydraulic cylinder means to rotate said pouring means based on the sensed thickness of metal strip; and b) means for attaching said pouring means to said feeding means;

means for rotating said pouring means and said feeding means together as a unit;

sensor means for sensing the thickness of the metal strip moving along said means for moving and cooling metal strip; and said sensor means having means for sending a signal to said rotating means to rotate said pouring means and said feeding means based on the sensed thickness of the metal strip;

said pouring means has an interior surface and an exterior surface;

said pouring means has a first point and a second point;

said second point is disposed on said longitudinal axis;

said first point is disposed away from said second point;

said first point is disposed between said second point and said interior surface;

said exit means extends radially from said interior surface to said exterior surface in a direction substantially in alignment with said first point;

said angle from said vertical axis is about 70°;

said means for varying further comprises means for varying the pressure of the molten metal at said outlet means;

said means for varying the pressure comprises means for varying the hydrostatic height of the molten metal to vary the pressure of the molten metal at said outlet means;

said machine further comprises:

means for covering, said means for covering for covering at least over said outlet means, said means for covering defining a space with respect to said moving and cooling means, said space containing a gaseous medium;

said covering means comprises one of the following sets of features c) and d):

c) said covering means comprises a portion extending from said pouring means towards said means for moving and cooling metal strip;

said portion being disposed at an angle with respect to said means for moving and cooling metal strip;

said portion having a first end and a second end;

said first end is disposed adjacent said pouring means;

said second end is disposed to form a clearance with said means for moving and cooling metal strip;

said means for receiving being disposed within said covering means; and d) said covering means comprises a portion surrounding at least said pouring means and said means for receiving and guiding;

said portion having a first end and a second end;

said first end is disposed adjacent said means for moving and cooling metal strip;

said second end is disposed adjacent said means for moving and cooling metal strip, at a predetermined distance from said first end;

said means for varying further comprises means for sensing and for controlling the level of molten metal in said pouring means based on the sensed level of molten metal in said pouring means;

said pouring means further comprises a substantially tubular shape;

said pouring means is disposed in a direction substantially perpendicular to said direction of movement;

said pouring means further comprises one of the following sets of features e) and f);

e) a first end and a second end;

said first end being disposed adjacent said feeding means;

said second end being disposed axially from said first end;

said second end comprising orifice means for permitting molten metal to exit said pouring means substantially only during preheating of said pouring means;

stopper means for being inserted into said orifice means after the preheating of said pouring means; and f) a first end and a second end;

said first end being disposed adjacent said feeding means;

said second end being disposed axially from said first end;

said second end comprising an end wall portion;

said end wall portion being configured to prevent the flow of molten metal from said pouring means during casting;

said end wall portion comprising orifice means for permitting the exit of molten metal from said pouring means substantially only during preheating of said pouring means;

said machine further comprising:

means for controlling the velocity of said moving and cooling means;

pipe means for supplying molten metal to said feeding means;

said means for moving and cooling metal strip comprises a plurality of nozzles disposed along said means for moving and cooling metal strip;

said plurality of nozzles are configured for spraying a cooling substance towards the metal strip moving along said means for moving and cooling metal strip;

said exit means comprises a plurality of outlet holes;

said outlet means comprises a total area; and said pouring means has an interior area, said interior area of said pouring means is one of: at least three times; and at least five times; greater than said total area of said outlet means.

11. A machine for the continuous casting of a metal strip, said machine comprising:

means for moving and cooling metal strip disposed in a substantially horizontal direction;

said means for moving and cooling metal strip having a direction of movement;

means for pouring molten metal to be received by said means for moving and cooling metal strip;

said means for pouring having a longitudinal axis;

said longitudinal axis of said means for pouring being disposed in a direction to form an angle with said direction of movement of said means for moving and cooling metal strip;

said means for pouring comprising:

outlet means for permitting the exit of molten metal from said pouring means;

said outlet means being disposed on at least a portion of said pouring means;

means for receiving and guiding molten metal, having exited from said outlet means, to said means for moving and cooling metal strip;

means for covering, said means for covering for covering at least over said outlet means, said means for covering defining a space with respect to said moving and cooling means, said space containing a gaseous medium;

said covering means comprising one of the following sets of features a) and b):

a) said covering means comprises a portion extending from said pouring means towards said means for moving and cooling metal strip;

said portion being disposed at an angle with respect to said means for moving and cooling metal strip;

said portion having a first end and a second end;

said first end is disposed adjacent said pouring means;

said second end is disposed to form a clearance with said means for moving and cooling metal strip;

said means for receiving being disposed within said covering means; and b) said covering means comprises a portion surrounding at least said pouring means and said means for receiving and guiding;

said portion having a first end and a second end;

said first end being disposed adjacent said means for moving and cooling metal strip;

said second end being disposed adjacent said means for moving and cooling metal strip, at a predetermined distance from said first end;

said receiving means being disposed to contact at least a portion of said outlet means;

said means for receiving comprising:

a bottom portion and first and second side portions;

said bottom portion having a first side and a second side disposed opposite from one another;

said bottom portion being disposed in a direction substantially parallel to said means for moving and cooling metal strip;

said first side portion being disposed along said first side of said bottom portion and said second side being disposed along said second side of said bottom portion to form a U shape;

said bottom portion comprising an indented portion configured for allowing molten metal exiting from said exit means to accumulate in said indented portion and to calm;

said bottom portion further comprising a raised portion disposed adjacent said indented portion, said raised portion being configured for permitting the molten metal to move onto said means for moving and cooling metal strip.

12. The machine according to claim 11 wherein:

said pouring means has a vertical axis and a horizontal axis and at least one side;

said outlet means is disposed on at least a portion of said at least one side of said pouring means;

said outlet means comprises exit means for permitting a stream of molten metal to exit said outlet means at a substantial angle from said vertical axis and a substantial angle from said horizontal axis, said angle from said vertical axis being substantially larger than said angle from said horizontal axis;

said machine further comprises means for feeding molten metal to be received by said pouring means;

said means for varying comprises one of the following sets of features c) and d):

c) coupling means for permitting said pouring means to rotate independently of said feeding means;

hydraulic cylinder means for rotating said pouring means;

sensor means for sensing the thickness of the metal strip moving along said means for moving and cooling metal strip;

said sensor means having means for sending a signal to said hydraulic cylinder means to rotate said pouring means based on the sensed thickness of the metal strip; and d) means for attaching said pouring means to said feeding means;

means for rotating said pouring means and said feeding means together as a unit;

sensor means for sensing the thickness of the metal strip moving along said means for moving and cooling metal strip;

said sensor means having means for sending a signal to said means for rotating to rotate said pouring means and said feeding means based on sensed thickness of the metal strip;

said pouring means having an interior surface and an exterior surface;

said pouring means having a first point and a second point;

said second point is disposed on said longitudinal axis;

said first point is disposed away from said second point said first point is disposed between said second point and said interior surface;

said exit means extends radially from said interior surface to said exterior surface in a direction substantially in alignment with said first point;

said angle from said vertical axis is about 70° with respect to said vertical axis;

said means for varying further comprises means for varying the pressure of the molten metal at said outlet means;

said means for varying the pressure comprises means for varying the hydrostatic height of the molten metal to vary the pressure of the molten metal at said outlet means;

said exit means comprises means for pouring the stream of molten metal into a gaseous medium which is in the environs of said outlet means;

said machine further comprises:

means for receiving and guiding the stream of molten metal, having exited into the gaseous medium from said exit means, to said means for moving and cooling metal strip;

said receiving means comprises one of the following sets of features e) and f):

e) said means for receiving comprises a first wall portion and a second wall portion disposed a distance from one another, the stream of molten metal forming a pool between said first wall portion and said second wall portion, said pool having a height;

said first wall portion is disposed between said pouring means and said means for moving and cooling metal strip, said first wall portion and said second wall portion forming a clearance with said means for moving and cooling metal strip, said clearance having a height extending from said means for moving and cooling metal strip to said first wall portion; and said first wall portion and said second wall portion are configured such that said height of said pool is at least two times as great as said height of said clearance; and f) said receiving means is disposed to contact at least a portion of said exit means;

said means for receiving comprises:

a bottom portion and first and second side portions;

said bottom portion having a first side and a second disposed opposite from one another;

said bottom portion is disposed in a direction substantially parallel to said means for moving and cooling metal strip;

said first side portion is disposed along said first side of said bottom portion and said second side is disposed along said second side of said bottom portion to form a U shape;

said bottom portion comprises an indented portion configured for allowing molten metal exiting from said exit means to accumulate in said indented portion and to calm;

said bottom portion further comprises a raised portion disposed adjacent said indented portion, said raised portion being configured for permitting the molten metal to move onto said means for moving and cooling metal strip;

said means for varying further comprises means for sensing and for controlling the level of molten metal in said pouring means based on the sensed level of molten metal in said pouring means;

said pouring means further comprises a substantially tubular shape;

said pouring means is disposed in a direction substantially perpendicular to said direction of movement;

said pouring means further comprises one of the following sets of features g) and h);

g) a first end and a second end;

said first end being disposed adjacent said feeding means;

said second end being disposed axially from said first end;

said second end comprising orifice means for permitting molten metal to exit said pouring means substantially only during preheating of said pouring means;

stopper means for being inserted into said orifice means after the preheating of said pouring means; and h) a first end and a second end;

said first end being disposed adjacent said feeding means;

said second end being disposed axially from said first end;

said second end comprising an end wall portion;

said end wall portion being configured to prevent the flow of molten metal from said pouring means during casting;

said end wall portion comprising orifice means for permitting the exit of molten metal from said pouring means substantially only during preheating of said pouring means;

said machine further comprising:

means for controlling the velocity of said means for moving and cooling metal strip;

pipe means for supplying molten metal to said feeding means;

said means for moving and cooling metal strip comprises a plurality of nozzles disposed along said means for moving and cooling metal strip;

said plurality of nozzles are configured for spraying a cooling substance towards the metal strip moving along said means for moving and cooling metal strip;

said exit means comprises a plurality of outlet holes;

said outlet means comprises a total area; and said pouring means has an interior area, said interior area of said pouring means is one of: at least three times; and at least five times; greater than said total area of said outlet means.

13. A machine for the continuous casting of a metal strip, said machine comprising:

means for moving and cooling metal strip disposed in a substantially horizontal direction;

said means for moving and cooling metal strip having a direction of movement;

means for pouring molten metal to be received by said means for moving and cooling metal strip, said pouring means being mounted for rotation;

said means for pouring having a longitudinal axis;

said longitudinal axis of said means for pouring being disposed in a direction to form an angle with said direction of movement of said means for moving and cooling metal strip;

said means for pouring comprising:

outlet means for permitting the exit of molten metal from said pouring means;

said outlet means being disposed on at least a portion of said pouring means;

said outlet means comprising exit means for pouring a stream of molten metal into a gaseous medium which is in the environs of said outlet means;

means for receiving and guiding a stream of molten metal, having exited into the gaseous medium from said exit means, to said means for moving and cooling metal strip;

means for varying the pressure of the molten metal at said outlet means;

said means for varying the pressure comprising:

means for varying the hydrostatic height of the molten metal to vary the pressure of the molten metal at said outlet means; and said means for varying the hydrostatic height comprises means for rotating said pouring means.

14. A machine for the continuous casting of a metal strip, said machine comprising:

means for moving and cooling metal strip disposed in a substantially horizontal direction;

said means for moving and cooling metal strip having a direction of movement;

means for pouring molten metal to be received by said means for moving and cooling metal strip;

said means for pouring having a longitudinal axis;

said longitudinal axis of said means for pouring being disposed in a direction to form an angle with said direction of movement of said means for moving and cooling metal strip;

said means for pouring comprising:

outlet means for permitting the exit of molten metal from said pouring means;

said outlet means being disposed on at least a portion of said pouring means;

said outlet means comprising exit means for pouring a stream of molten metal into a gaseous medium which is in the environs of said outlet means; and means for receiving and guiding a stream of molten metal, having exited into the gaseous medium from said exit means, to said means for moving and cooling metal strip;

said means for receiving comprising:

a bottom portion and first and second side portions;

said bottom portion having a first side and a second side disposed opposite from one another;

said bottom portion being disposed in a direction substantially parallel to said means for moving and cooling metal strip;

said first side portion being disposed along said first side of said bottom portion and said second side being disposed along said second side of said bottom portion to form a U shape;

said bottom portion comprising an indented portion configured for allowing molten metal exiting from said exit means to accumulate in said indented portion and to calm; and said bottom portion further comprising a raised portion disposed adjacent said indented portion, said raised portion being configured for permitting the molten metal to move onto said means for moving and cooling metal strip.

15. A machine for the continuous casting of a metal strip, said machine comprising:

means for moving and cooling metal strip disposed in a substantially horizontal direction;

said means for moving and cooling metal strip having a direction of movement;

means for pouring molten metal to be received by said means for moving and cooling metal strip;

said means for pouring having a longitudinal axis;

said longitudinal axis of said means for pouring being disposed in a direction to form an angle with said direction of movement of said means for moving and cooling metal strip;

means for rotating said means for pouring about said longitudinal axis of said pouring means;

said means for pouring comprising:

outlet means for permitting the exit of molten metal from said pouring means;

said outlet means being disposed on at least a portion of said pouring means;

said outlet means comprising exit means for pouring a stream of molten metal into a gaseous medium which is in the environs of said outlet means;

means for receiving and guiding a stream of molten metal, having exited into the gaseous medium from said exit means, to said means for moving and cooling metal strip.;

said means for receiving comprising:

a bottom portion and first and second side portions;

said bottom portion having a first side and a second side disposed opposite from one another;

said bottom portion is disposed in a direction substantially parallel to said means for moving and cooling metal strip;

said first side portion is disposed along said first side of said bottom portion and said second side is disposed along said second side of said bottom portion to form a U shape;

said first side portion, said second side portion, and said bottom portion together forming a hollow portion configured for allowing molten metal exiting from said exit means to accumulate in said hollow portion and to calm;

said bottom portion further comprises a raised portion disposed adjacent said hollow portion; and means for permitting the molten metal to move onto said means for moving and cooling metal strip.

16. A method of continuously casting metal strip, said method comprising the steps of:

providing means for feeding molten metal;

providing means for pouring;

providing outlet means in the pouring means;

providing means for moving and cooling metal strip;

attaching the feeding means to the pouring means;

feeding molten metal, with the feeding means, to the pouring means;

disposing the means for moving and cooling metal strip in a horizontal direction, the means for moving and cooling metal strip having a direction of movement;

receiving molten metal from the outlet means with the means for moving and cooling metal strip;

moving and cooling metal strip in the direction of movement of the means for moving and cooling metal strip;

discharging a stream of molten metal from the outlet means at a substantial angle from a vertical axis of the pouring means and a substantial angle from a horizontal axis of the pouring means;

said method further comprising the steps of:

providing means for rotating at least the pouring means;

providing an end outlet in one end of the pouring means;

rotating the pouring means, with the means for rotating, and moving the outlet means in an upward direction, away from the means for moving and cooling metal strip, to prevent the flow of molten metal from the outlet means, and moving the end outlet in a downward direction, towards the means for moving and cooling metal strip, to allow the flow of molten metal from the end outlet; and preheating the pouring means by flowing molten metal through the pouring means and out of the end outlet of the pouring means.

17. The method according to claim 16 further comprising the steps of:

providing means for controlling the level of molten metal in the pouring means; and controlling the level of molten metal in the pouring means with the means for controlling.

18. The method according to claim 17 wherein said step of controlling the level of molten metal in the pouring means further comprises maintaining the level of molten metal in the pouring means so that the pouring means is only partially filled with molten metal during casting.

19. The method according to claim 18, said method further comprising the step of:

beginning casting, and ending said step of preheating, by rotating the pouring means, with the rotating means, and moving the outlet means in a downward direction towards the means for moving and cooling metal strip so that the outlet means is below the level of molten metal in the pouring means, and so that the end outlet is above the level of molten metal in the pouring means.

20. The method according to claim 19, said method further comprising the steps of:

adjusting the quality of the metal strip by performing one of the following steps a), b) and c):

a) providing means for adjusting the velocity of the means for moving and cooling metal strip;

adjusting the velocity of the means for moving and cooling metal strip with the means for adjusting;

b) adjusting the level of molten metal in the pouring means with the means for controlling; and c) rotating the pouring means with the rotating means.

21. A method of continuously casting metal strip, said method comprising the steps of:

providing means for feeding molten metal;

providing means for pouring;

providing outlet means in the pouring means;

providing means for moving and cooling metal strip;

providing means for varying the pressure at the outlet means;

attaching the feeding means to the pouring means;

feeding molten metal, with the feeding means, to the pouring means;

discharging molten metal from the outlet means;

disposing the means for moving and cooling metal strip in a horizontal direction, the means for moving and cooling metal strip having a direction of movement;

receiving molten metal from the outlet means with means for moving and cooling metal strip;

moving and cooling metal strip in the direction of movement of the means for moving and cooling metal strip; and varying the pressure of the molten metal at the outlet means with the means for varying.

22. The method according to claim 21 further comprising the steps of:

providing means for rotating at least the pouring means;

providing an end outlet in one end of the pouring means;

rotating the pouring means, with the means for rotating, and moving the outlet means in an upward direction, away from the means for moving and cooling metal strip, to prevent the flow of molten metal from the outlet means, and moving the end outlet in a downward direction, towards the means for moving and cooling metal strip, to allow the flow of molten metal from the end outlet; and preheating the pouring means by flowing molten metal through the pouring means and out of the end outlet in the pouring means.

23. The method according to claim 22 further comprising the steps of:

providing means for controlling the level of molten metal in the pouring means;

controlling the level of molten metal in the pouring means with the means for controlling; and said step of controlling the level of molten metal further comprises maintaining the level of molten metal in the pouring means so that the pouring means is at least partially filled with molten metal during casting.

24. The method according to claim 23, said method further comprising the step of:

beginning casting, and ending said step of preheating, by rotating the pouring means, with the rotating means, and moving the outlet means in a downward direction towards the means for moving and cooling metal strip so that the outlet means is below the level of molten metal in the pouring means, and so that the end outlet is above the level of molten metal in the pouring means.

25. The method according to claim 24, said method further comprising the step of:

adjusting the quality of the metal strip by performing one of the following steps a), b) and c):

a) providing means for adjusting the velocity of the means for moving and cooling metal strip;

adjusting the velocity of the means for moving and cooling metal strip with the means for adjusting;

b) adjusting the level of molten metal in the pouring means with the means for controlling; and c) rotating the pouring means with the rotating means.

26. A method of continuously casting metal strip, said method comprising the steps of:

providing means for feeding molten metal;

providing means for pouring;

providing outlet means in the pouring means;

providing means for moving and cooling metal strip;

providing an end outlet in one end of the pouring means;

attaching the feeding means to the pouring means;

feeding molten metal, with the feeding means, to the pouring means;

disposing the means for moving and cooling metal strip in a substantially horizontal direction, the means for moving and cooling metal strip having a direction of movement;

disposing the pouring means substantially transversely with respect to the means for moving and cooling metal strip;

receiving molten metal from the outlet means with the means for moving and cooling metal strip;

moving and cooling metal strip in the direction of movement of the means for moving and cooling metal strip;

discharging a stream of molten metal from the outlet means at a substantial angle from a vertical axis of the pouring means and a substantial angle from a horizontal axis of the pouring means; and preheating the pouring means by flowing molten metal through the pouring means and out of the end outlet of the pouring means.

27. A method of continuously casting metal strip, said method comprising the steps of:

providing means for feeding molten metal;

providing means for pouring;

providing outlet means in the pouring means;

providing means for moving and cooling metal strip;

attaching the feeding means to the pouring means;

feeding molten metal, with the feeding means, to the pouring means;

disposing the pouring means substantially transversely with respect to the means for moving and cooling metal strip;

disposing the means for moving and cooling metal strip in a substantially horizontal direction, the means for moving and cooling metal strip having a direction of movement;

receiving molten metal from the outlet means with the means for moving and cooling metal strip;

moving and cooling metal strip in the direction of movement of the means for moving and cooling metal strip;

discharging a stream of molten metal from the outlet means at a substantial angle from a vertical axis of the pouring means and a substantial angle from a horizontal axis of the pouring means;

providing means for rotating at least the pouring means;

providing an end outlet in one end of the pouring means;

rotating the pouring means, with the means for rotating, and moving the outlet means in an upward direction, away from the means for moving and cooling metal strip, to prevent the flow of molten metal from the outlet means; and preheating the pouring means by flowing molten metal through the pouring means and out of the end outlet in the pouring means.

* * * * *

UNITED STATES PATENT AND TRADEMARK OFFICE

CERTIFICATE OF CORRECTION

PATENT NO. : 5,538,071
DATED : July 23, 1996
INVENTOR(S) : Lars Gunnar JOHANSSON and Ralph NYSTRÖM It is certified that error appears in the above-indentified patent and that said Letters Patent is hereby corrected as shown below:

On the title page, item [75], after 'Johansson,', delete "Luleå" and insert --Luleå--.

In column 2, line 1, before 'to', delete "liquid-steel" and insert --liquid steel--.

Signed and Sealed this

First Day of April, 1997

Attest:

Bruce Lehman

BRUCE LEHMAN

Attesting Officer

Commissioner of Patents and Trademarks